US005970576A

United States Patent [19]

Maurer et al.

[11] Patent Number: 5,970,576

[45] Date of Patent: Oct. 26, 1999

[54] VACUUM CLEANER HEIGHT ADJUSTMENT

[75] Inventors: Edgar A. Maurer, Canton; Richard A. Wareham; Kurt D. Harsh, both of North Canton; Michael W. Crine, Sebring, all of Ohio

[73] Assignee: The Hoover Company, North Canton, Ohio

[21] Appl. No.: 08/824,769

[22] Filed: Mar. 26, 1997

[51] Int. Cl.[6] ..... A47L 5/34

[52] U.S. Cl. ..... 15/354; 15/339

[58] Field of Search ..... 15/354, 355, 356

[56] References Cited

U.S. PATENT DOCUMENTS

| | | | |
|---|---|---|---|
| 1,327,456 | 1/1920 | Baender . | |
| 1,347,167 | 7/1920 | Kirby . | |
| 2,102,802 | 12/1937 | Lofgren . | |
| 3,262,147 | 7/1966 | Waters et al. . | |
| 3,439,375 | 4/1969 | Eades . | |
| 3,683,448 | 8/1972 | Lagerstrom et al. | 15/354 |
| 4,171,554 | 10/1979 | Tschudy . | |
| 5,134,750 | 8/1992 | King et al. | 15/356 X |
| 5,269,042 | 12/1993 | Stephens et al. | 15/356 |
| 5,317,784 | 6/1994 | Glenn et al. | 15/356 |
| 5,467,502 | 11/1995 | Johnson et al. | 15/354 X |
| 5,499,425 | 3/1996 | Glenn | 15/354 |

FOREIGN PATENT DOCUMENTS

| | | |
|---|---|---|
| 551069 | 1/1992 | European Pat. Off. . |

*Primary Examiner*—Chris K. Moore

*Attorney, Agent, or Firm*—A. Burgess Lowe; Bruce P. Watson

[57] ABSTRACT

A suction nozzle is provided with a linearly movable, stepped cam which adjusts the height of the suction nozzle by acting against a pivoted wheel carriage. The stepped cam is relatively fixedly positioned by an indexing means including a deflectable arm which is manually deformed to release the fixed indexing and then manipulated in a sideward direction to move the position of the stepped linear cam means.

19 Claims, 5 Drawing Sheets

VACUUM CLEANER HEIGHT ADJUSTMENT

BACKGROUND OF THE INVENTION

1. Field of the Invention

This invention relates to vacuum cleaners and, more specifically, relates to a height adjusting arrangement for such a vacuum cleaner.

2. Summary of the Prior Art

It is known to provide a cleaner nozzle height elevating cam arrangement which is utilized, in conjunction with an included indexing structure, that maintains the position to which the cam is manipulated, to provide a selected cleaner nozzle height adjustment. However, although these elevating cams are normally manually actuated, heretofore, there has been no cleaner height elevating cam manual manipulating arrangement which tended to automatically release the indexing structure so that another nozzle height adjustment could be more easily obtained.

Accordingly, it is an object of the invention to provide an improved nozzle height adjusting manipulating means.

It is an additional object of the invention to provide an improved nozzle height adjustment indexing structure manipulating means.

It is a further object of the invention to provide an improved indexing means for use with a stepped linear cam nozzle height adjusting arrangement.

It is even a further object of the invention to provide a deformable indexing means for use with a height adjusting cam for a vacuum cleaner nozzle.

SUMMARY OF THE INVENTION

A suction nozzle is pivoted at its rear to a cleaner handle and is provided with a pair of aligned bottom wheels forwardly of this pivot and on the underside of the nozzle. These wheels are mounted on a strut structure which is also pivoted to the nozzle so that the height of the nozzle may be adjusted by moving the wheels outwardly or inwardly therefrom as their strut structure pivots outwardly or inwardly relative to the bottom of the suction nozzle. To control this movement a linearly stepped cam is slidingly, track mounted to move across the suction nozzle and between it and a center upstanding projection on the strut structure. Attached to an upper side of the stepped cam and accessible to the user by its exposure through the top side of the suction nozzle is an arched finger piece which may be easily used for manual manipulation by an operator placing his finger thereunder. This arched piece is integral with an indexing piece that is cantilevered off an upper, attached cover for the linearly stepped cam. This upper cover is secured to the linearly stepped cam to trap a portion of the suction nozzle wall therebetween so that it and the linearly stepped cam may easily slide as aforesaid across the suction nozzle. The indexing piece includes a portion that serves as a projecting detent point and is received in one of a series of laterally spaced detent receiving pockets formed in a plate fixed with respect to the suction nozzle and jutting from its top surface. Since the indexing piece is cantilevered, upward finger pressure on the arched finger piece tends to release the detent point of the indexing piece so that the linearly stepped height adjusting cam may be easily translated across the suction nozzle for facilitated height adjustment of it by continuing to manipulate the arched finger piece in a translatory direction.

BRIEF DESCRIPTION OF THE DRAWINGS

Reference may now be had to the accompanying Drawings for a better understanding of the invention, both as to its organization and function, with the illustration only showing a preferred embodiment, but being only exemplary and in which.

DETAILED DESCRIPTION OF THE INVENTION

Figure 1:
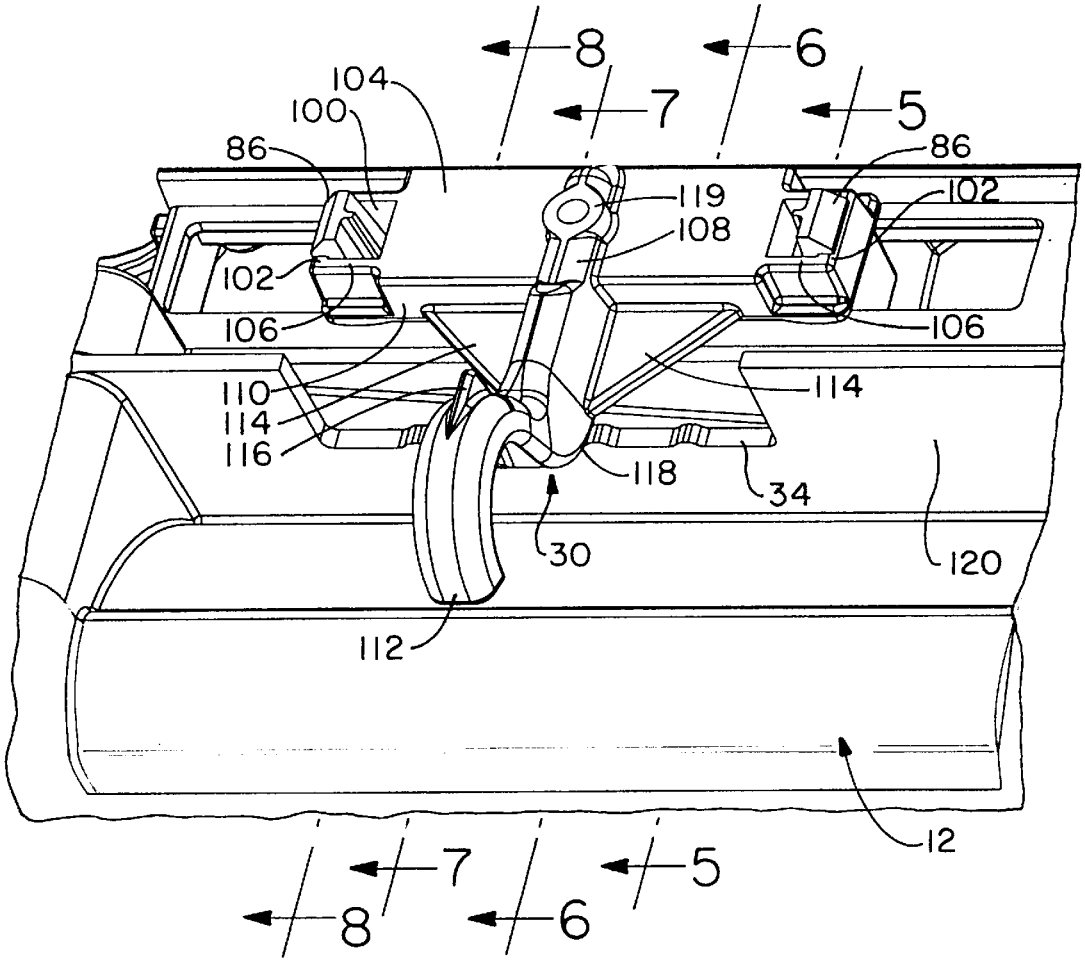
FIG. 1 is a leftward, partial perspective view looking downwardly on the top side of a suction nozzle which incorporates the invention.
Figure 4:
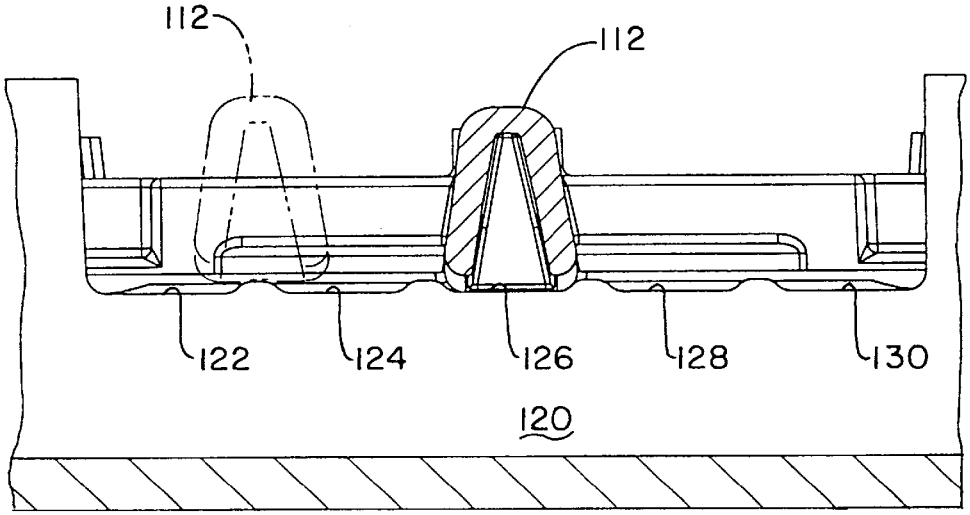
FIG. 4 is a partial, vertical, transverse sectional view of the suction nozzle taken immediately in front of the detent plate of the indexing arrangement and looking rearwardly.
Figure 2:
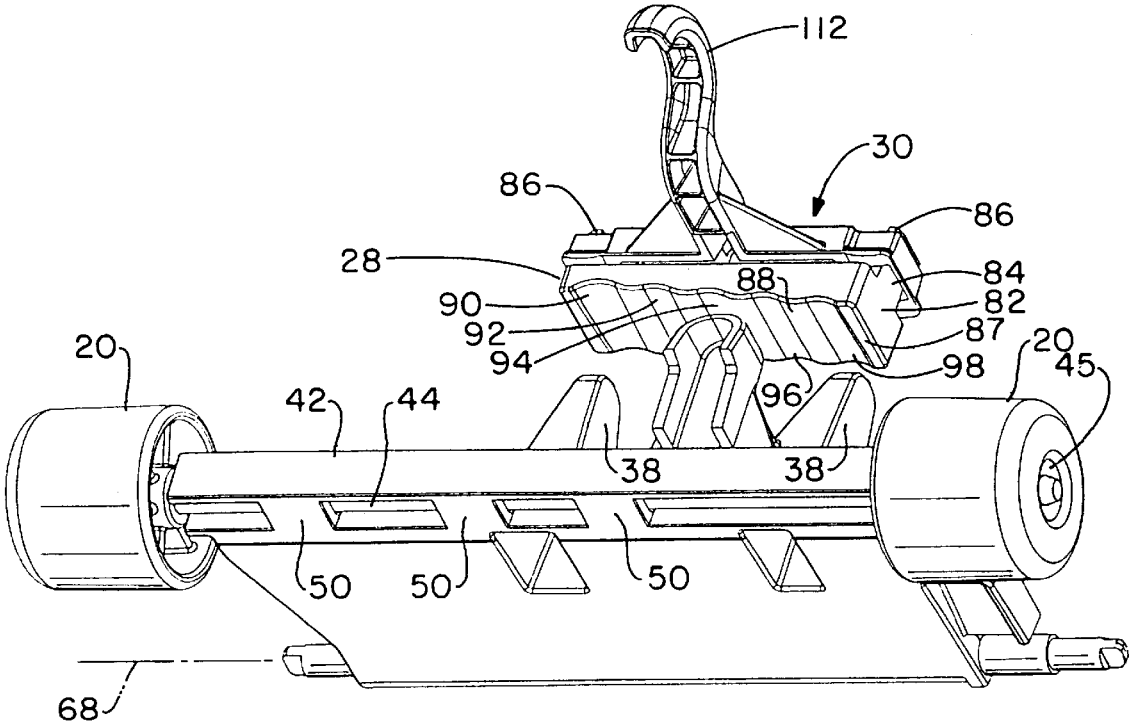
FIG. 2 is a leftward, partial perspective view looking upwardly toward the wheels, their mounting structure and incorporated height adjustment and indexing arrangement.
Figure 3:
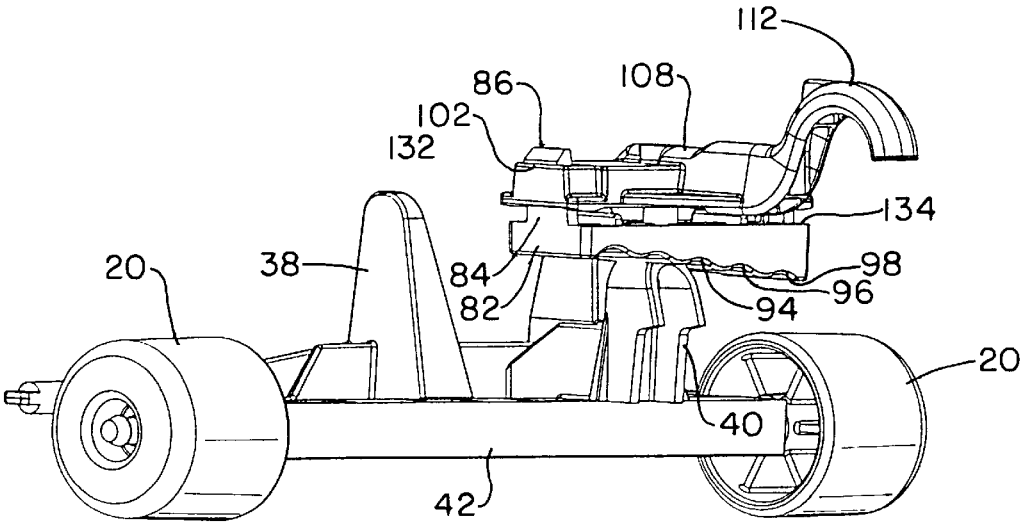
FIG. 3 is a rightward, partial perspective view looking slightly upwardly toward the inventive arrangement shown in FIG. 2.
Figure 5:
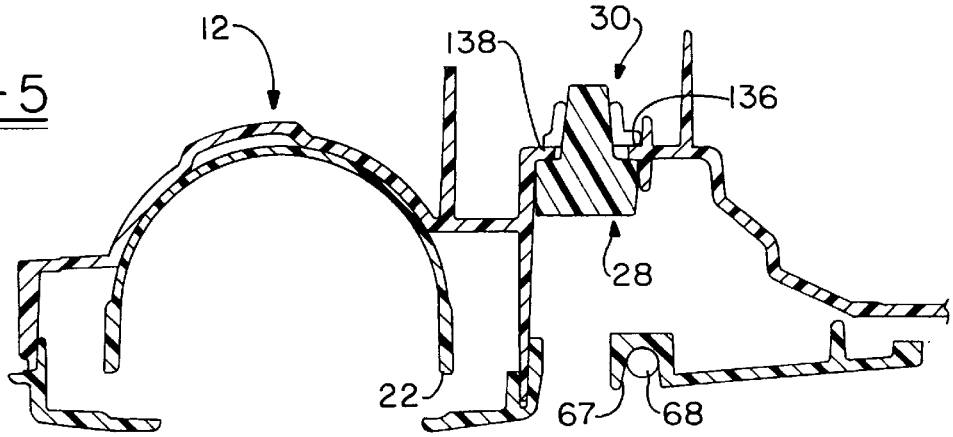
FIG. 5 is a partial vertical longitudinal sectional view of the suction nozzle and incorporated invention taken on line 5—5 of FIG. 1.
Figure 6:
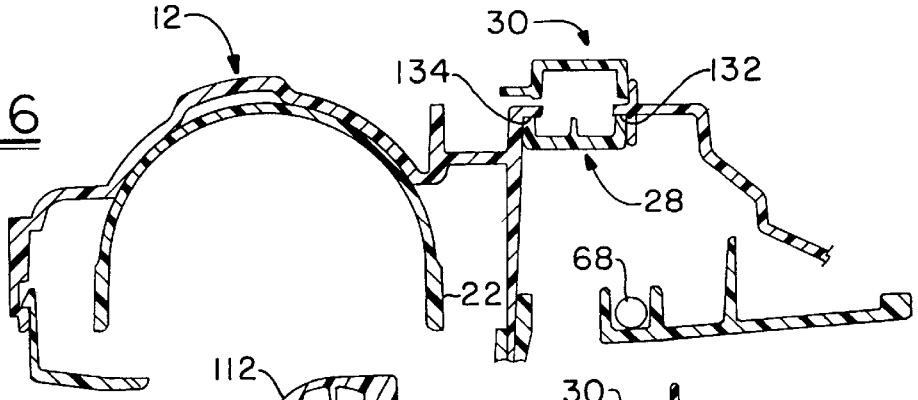
FIG. 6 is a partial vertical longitudinal sectional view of the suction nozzle and incorporated invention taken on line 6—6 of FIG. 1.
Figure 7:
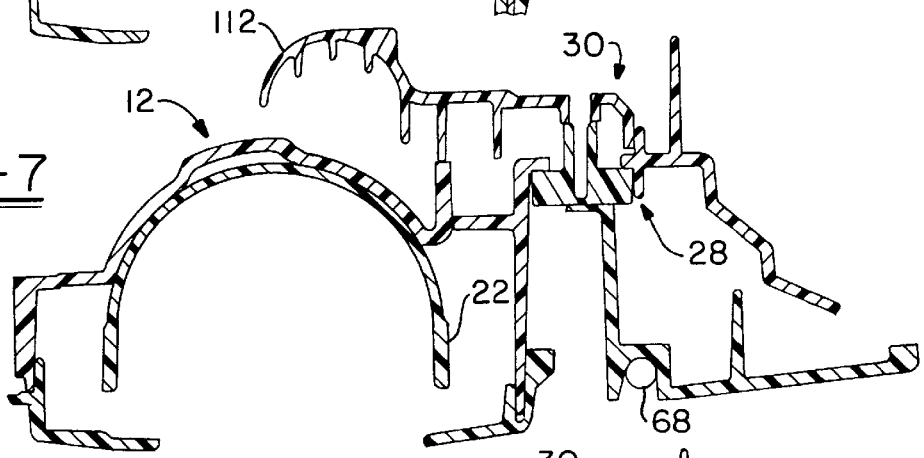
FIG. 7 is a partial, vertical longitudinal sectional view of the suction nozzle and incorporated invention, taken on line 7—7 of FIG. 1.
Figure 8:
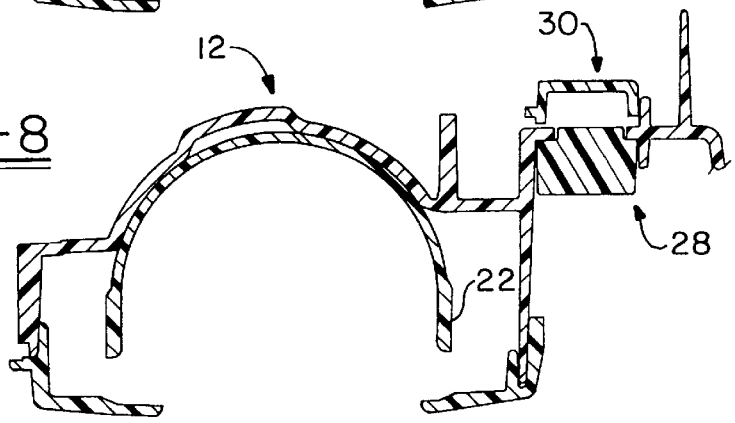
FIG. 8 is a partial, vertical longitudinal sectional view of the suction nozzle and incorporated invention taken on line 8—8 of FIG. 1.
Figure 9:
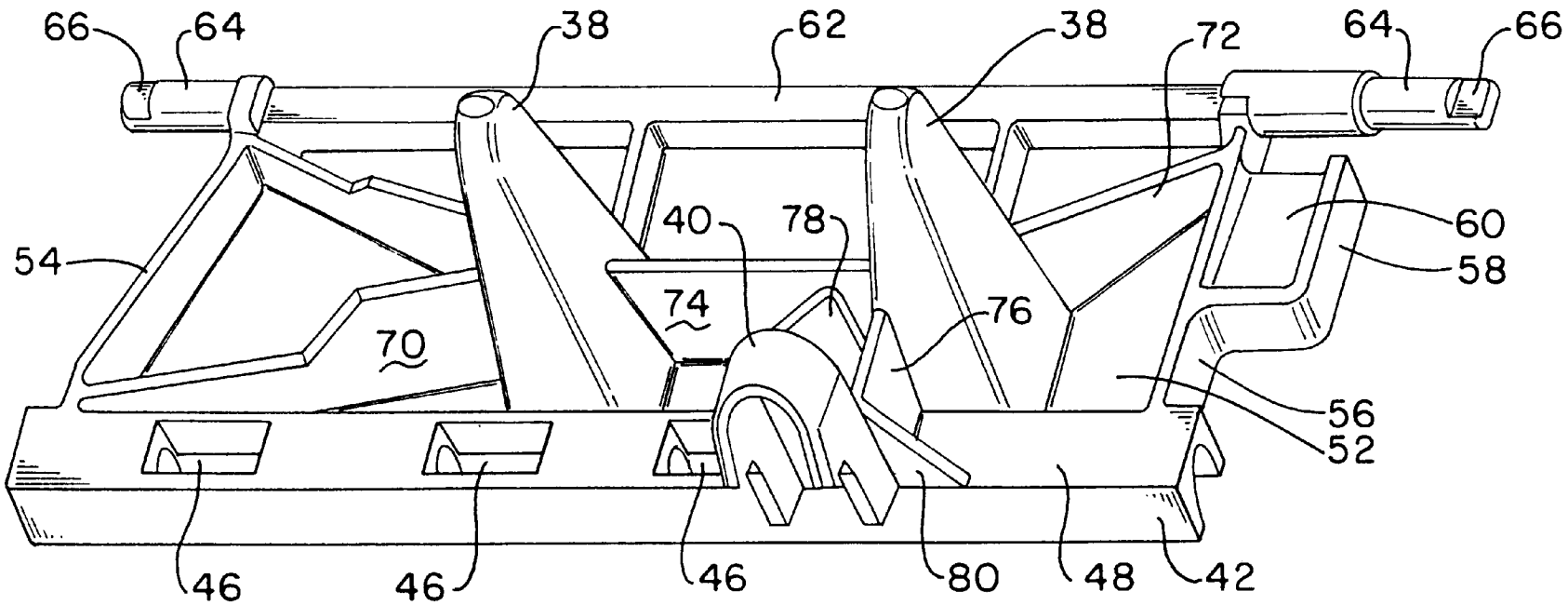
FIG. 9 is a right side, upper, perspective view looking downwardly toward the wheel carriage utilized in this invention.
Figure 10:
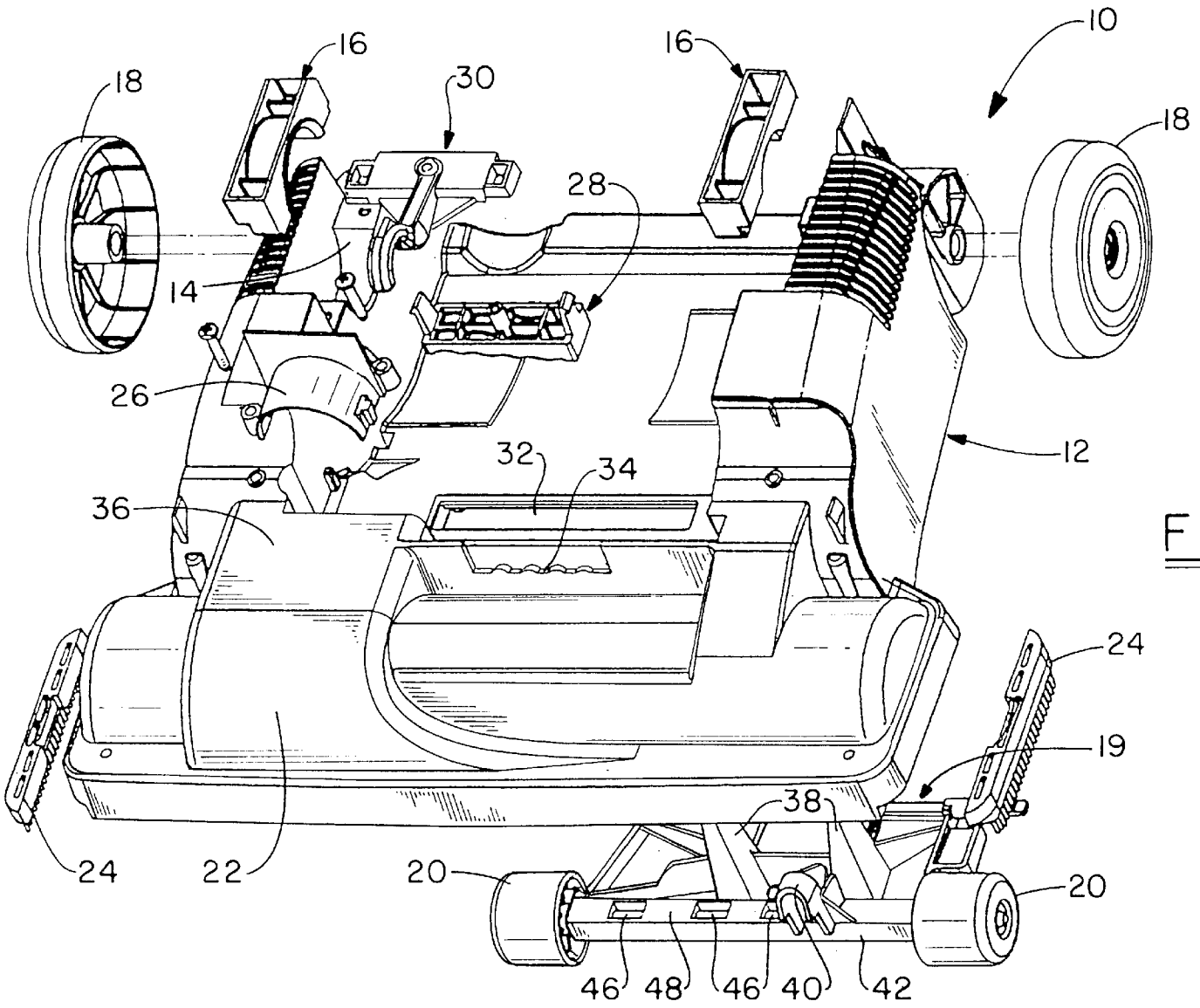
FIG. 10 is an exploded view of the suction nozzle and incorporated invention.

In the Drawings, there is shown in FIG. 10, a vacuum cleaner 10 having a suction nozzle 12 provided with a rearward conventional handle fastening pivot yoke arrangement 14, 16 to which is pivoted a handle (not shown), in this case a hard bag upper portion (not shown). The suction nozzle 12 is supported rearwardly by a transversely spaced pair of wheels 18, 18 and forwardly by a pair of transversely spaced front wheels 20, 20 mounted on a movable wheel carriage 19. The suction nozzle 12, at its forward side, includes an agitator chamber 22 conveniently mounting a rotatably driven agitator (not shown). Side litter picker strips 24, 24 may be rib attached to the bottom plate (not shown) of the suction nozzle 10 at the ends of the agitator chamber 22 through the illustrated slots in litter picker strips 24, 24. A hose clamp 26 confluently connects a suction hose (not shown) to the agitator chamber 22. This hose leads upwardly to the hard bag portion (not shown) of the cleaner 10 for the transfer of dirty air to a cleaner bag (not shown) contained therein.

A linear stepped cam means 28 and an indexing means 30 mounted with a slot 32 in the top side 36 of the suction nozzle 12 act in conjunction with the movable wheel mounting carriage 19 to raise and lower the suction nozzle 12. A detent means 34, mounted fast with the top side 36 of suction nozzle 12, cooperates with the indexing means 30 to insure positive positioning of the stepped cam means 28. The wheel mounting carriage 19 also includes, along with the mounted wheels 20, 20, a pair of upstanding laterally spaced prong members 38, 38 that act with an abutting structure (not shown) on a bottom housing section (not shown) of the hard bag portion when the hard bag portion is pivoted to upright position. Movement of the hard bag portion to this position, raises the suction nozzle 12 by lowering the wheels 20, 20 of the movable wheel carriage 19. A finger 40, disposed somewhat intermediate and forward of the prong members 38, 38 also is furnished as an engagement means; this for the linear stepped cam means 28 so as to provide for manual raising and lowering of the suction nozzle 12.

The organization and arrangement of the inventive structure of the preceding paragraph will now be described. in greater detail with specific emphasis on FIGS. 1–9.

The movable carriage 19 includes, at its bottom, a wheel mounting general U-shaped (in cross section) strut 42 forming forward portions of it and disposed between the wheels 20, 20 and mounting a wheel axle 44 in a slip fit manner to extend from side to side therethrough. The wheels 20, 20 are mounted on opposite ends of this axle and the axle 44 and wheels 20, 20 held mountingly to the U-shaped strut 42 by plastic clip members 45, 45 (only one partially shown) inserted in the wheel ends and resiliently and compressingly encompassing the axle 44.

The U-shaped strut 42 includes a series of three top surface discontinuities 46, 46, 46 in a top surface 48 of it which lead inwardly to short bottom surfaces 50, 50, 50 on the bottom side of box shaped strut 42. The axle 44 is then vertically, securely non rotatably mounted between top surface 48 and bottom surfaces 50, 50, 50 of U-shaped strut 42 of wheel carriage 19 in a clam shell manner. The discontinuities 46, 46, 46 in U-shaped strut 42 provide for the easily molding of the bottom surfaces 50, 50, 50.

Rearwardly of the U-shaped strut 42 and integral therewith is a horizontally extending plate like member 52. This plate like member has an inwardly angled upstanding side member 54 which is so shaped so as to provide side to side clearance for the wheeled carriage 19 under the suction nozzle 12 and an opposite straight upstanding side member 56 having a flanged offset 58. The offset includes an angled floor 60 which receives on its underside one end of a torsion spring (not shown) that tends to maintain the wheeled carriage 19 upwardly within bottom confines of the suction nozzle 12.

The plate member 52 terminates at its rear in an integral generally cylindrical stringer 62 that extends axially outwardly beyond the side members 54, 56 and flanged offset 58 and include stub pintles 64, 64 that are shaped cylindrically, beyond the lateral extent of these side members. The stub pintles 64, 64 merge into somewhat flattened indented sections 66, 66. These pintles form, within corresponding pintle slots (not shown) (but both of which are shown in U.S. Pat. No. 5,134,750 issued Aug. 4, 1992, titled Cleaner with Conversion Valve Arrangement and owned by a common assignee) pivots 68, 68 with the suction nozzle 12. These pivots, as illustrated, are located on both sides of the wheeled carriage 19.

On its top side, the plate like member 52 includes the aforesaid integral prong members 38, 38 which urge the wheeled carriage 19 pivotally downwardly when contacted by the hard bag portion (not shown) of the cleaner 10 and the aforesaid finger 40 that is engaged by the linear stepped cam means 28 to permit manually controlled inward and outward pivoting of the wheeled carriage 19 dependent upon the locus of the linear stepped cam means 28 relative to the suction nozzle 12 and its finger 40.

These three elements are gusset reinforced in their integral mounting to the wheeled carriage 19 by: (1) angularly outwardly extending stepped outer gussets 70, 70 at one end of the wheeled carriage 19 and outwardly extending angled outer gusset 72 at the other end of the wheeled carriage 19; (2) intermediate gusset 74 extending between the prong member 38, 38; (3) intermediate gussets 76, 78 extending, respectively, linearly between the finger 40 and one of the prong members 38 and angularly between the finger 40 and the intermediate gusset 74; and (4) a triangularly shaped sidewardly extending gusset 80 disposed between and integral with the finger 40 and the U-shaped strut 42. All these gussets obviously contribute to the strength of the movable wheeled carriage 19. This completes the description of the wheeled carriage 19.

The linear stepped cam means 28 includes a rectangularly shaped (in plan view) bottom box section 82 which opens upwardly and includes integral side retainer arms 84, 84, each of which has an upper, outwardly facing hook end 86. A bottom side 87 of the linear stepped cam means bottom section 82 includes a stepped, angled cam ramp 88 having, e.g., descending cam steps 90, 92, 94, 96 and 98.

The linear stepped cam means 28 is mounted in the suction nozzle 12 by its engagement with the indexing means 30 by the hooks end 86, 86 of the retainer arms 84, 84 of the cam means 28 extending through transversely spaced open slots 100, 100 in the indexing means 30. The hooks engage over lips 102, 102 disposed coplanar with an upper flat side 104 of the indexing means 30 and formed by the U-shaped (in plan) box sections 106, 106 of the indexing means 30. These box sections are slightly smaller in cross section than the adjoining cross section at the upper flat side 104 of indexing means 30 to aid in moldability of this piece and to conserve material.

The top surface of flat upper side 104 of indexing means 30 includes an integral stem member 108 that is formed to extend thereabove for strengthening purposes and outwardly therefrom relative to the indexing means' downwardly open box configuration 110. The stem member 108 includes an outward, forwardly directed, downwardly curved hook portion 112 that serves as a manually graspable finger hold for the vacuum cleaner operator. The stem member 108 is open, girder like on its lower inner side to provide less chance for a sink developing during the molding of the indexing means 30.

A pair of strengthening triangular gussets 114, 114 are disposed in opposite sides of the stem member 108, inwardly of the curved hook portion 112 and adjacent its main juncture with the open box configuration 110 of the indexing means 30 to integrally join it and the open box configuration 110. A top small triangular vertically extending gusset 116 is also provided on the outside upper side of the hook portion 112. This gusset, primarily, serves as an indicator for the location of the indexing means 30 and an indexing nose 118 of the stem member 108, relative to the detent means 34.

The stem member includes an inner, enlarged boss like shape 119 that may serve as a screw mounting in the event that the hook ends 86, 86 of the retainer arms 84, 84 do not provide secure enough fastening.

As set out previously, the detent means 34 is mounted fast with and on the top side 36 of suction nozzle 12. This is accomplished through the aegis of an upstanding detent plate 120 having detent recesses 122, 124, 126, 128 and 130 into which the indexing nose 118 of the indexing means 30 selectively intrudingly engages.

Release of this intrusion occurs when the hook portion 112 of the stem member 108 is manually manipulated upwardly, deforming the stem member 108 and removing the indexing nose 118 at least partly out of one of its detenting recesses 122, 124, 126, 128 or 130 so that the indexing means 30 and attached linear cam 28 may be easily manually translated across the suction nozzle surface 36 to thereby interpose a different "step" of linear cam 28 between the nozzle proper and the finger 40 of wheeled carriage 19 to correspondingly pivot this carriage inwardly or outwardly of the suction nozzle 12.

The linear cam 28 and indexing means are easily guided in this translatory movement by both upwardly facing forward and rearward surfaces 132 and 134 on the stepped cam 28 and forward and rearward downwardly facing confronting surfaces 136, 138 on indexing means 30. The engagement between these two means is afforded by the guidance slot 32 extending transversely, through and along the suction nozzle 12 along the nozzle top side 36. Portions of the suction nozzle 12 adjacent the slot 32 are trapped between the stepped cam means surfaces 132 and 134 and the indexing means surfaces 136, 138 to complete the guidance arrangement for these two connected structures.

It should be clear by the description afforded that all the objects of the invention previously set out have been met. It should, further, be obvious that many modifications could be made to the invention which would still fall within its spirit and purview.

What is claimed is:

1. A height adjustment arrangement for a suction nozzle of a vacuum cleaner, said height adjustment arrangement comprising:

a) a wheel carriage pivotally mounted to said suction nozzle for supporting said suction nozzle on a floor surface;

b) a height adjusting cam linearly movable along said suction nozzle, said height adjusting cam having a cam surface positioned to engage said wheel carriage and cammingly pivot said wheel carriage relative said nozzle when said height adjusting cam is linearly displaced, to thereby adjust the height of said nozzle above a floor surface;

c) an actuator for selectively linearly displacing said height adjusting cam;

d) said actuator comprises a deflectable manual actuation tab extending from said height adjusting cam for operation of said actuator via an operator's finger; and e) wherein said actuation tab is a cantilever.

2. A height adjustment arrangement according to claim 1, wherein said manual actuation tab is generally hook shaped to facilitate actuation thereof by an operator's finger.

3. A height adjustment arrangement according to claim 1, wherein:

a) said suction nozzle includes a frame having a wall with a slot passing therethrough;

b) said height adjusting cam is wider than said slot and is located on a first side of said frame wall;

c) said actuator is wider than said slot and is located on a second side of said frame wall, opposite said height adjusting cam; and d) one of said height adjustment cam and said actuator has a mounting portion that extends through said slot in said frame wall, said mounting portion is fastened to the other of said height adjustment cam and said actuator, whereby said frame wall is sandwiched between said height adjustment cam and said actuator.

4. A height adjustment arrangement according to claim 3, wherein:

a) said mounting portion comprises a pair of resilient hook arms; and b) the other of said height adjustment cam and said actuator has a pair of hook receiving portions that are sized, shaped and located to receive said resilient hook arms and thereby snap said height adjustment cam and said actuator together.

5. A height adjustment arrangement according to claim 4, wherein said hook receiving portions are formed by a pair of through holes in said other of said height adjustment cam and said actuator.

6. A height adjustment arrangement for a suction nozzle of a vacuum cleaner, said height adjustment arrangement comprising:

a) a wheel carriage pivotally mounted to said suction nozzle for supporting said suction nozzle on a floor surface;

b) a height adjusting cam linearly movable along said suction nozzle, said height adjusting cam having a cam surface positioned to engage said wheel carriage and cammingly pivot said wheel carriage relative said nozzle when said height adjusting cam is linearly displaced, to thereby adjust the height of said nozzle above a floor surface;

c) an actuator for selectively linearly displacing said height adjusting cam;

d) said actuator comprises a deflectable manual actuation tab extending from said height adjusting cam for operation of said actuator via an operator's finger;

e) a series of indexing indents formed in said suction nozzle; and f) wherein said actuation tab is located such that a portion of said actuation tab is serially received in each of said indexing recesses to selectively indexably located said height adjusting cam relative said frame.

7. A height adjustment arrangement according to claim 6, wherein upon actuation of said actuation tab by an operator's finger, said actuation tab is deflected out of a select one of said indexing recesses for facilitating linear movement of said height adjusting means by an operator.

8. A height adjustment arrangement according to claim 7, wherein said actuation tab is a cantilever.

9. A height adjustment arrangement according to claim 7, wherein said actuation tab includes an indexing projection that is sized and shaped to be serially received in each of said indexing recesses.

10. A height adjustment arrangement according to claim 6, wherein said indexing indents are formed in a plate-like piece affixed to said suction nozzle.

11. A height adjustment arrangement according to claim 10, wherein said plate-like piece comprises a wall that is integrally molded as a part of said suction nozzle.

12. A height adjustment arrangement according to claim 10, wherein said actuation tab is a cantilever.

13. A height adjustment arrangement according to claim 12, wherein said actuation tabs includes a finger engaging portion located at an outer end of said cantilever.

14. A height adjustment arrangement according to claim 13, wherein said finger engaging portion is curved to comfortably engaged by an operator's finger.

15. A height adjustment arrangement according to claim 14, wherein said finger engaging portion is generally hook-shaped.

16. A height adjustment arrangement according to claim 1, wherein said wheel carriage includes at least one upwardly extending projection that is located for engagement by said cam surface.

17. A height adjustment arrangement according to claim 1, wherein said actuation tab includes a generally hook-shaped finger engaging portion located at an outer end of said cantilever.

18. A height adjustment arrangement according to claim 17, further comprising:

a) a series of indexing indents formed in said suction nozzle; and b) wherein said actuation tab is located such that an indexing portion of said actuation tab is selectively received in one of said indexing recesses to maintain said height adjusting cam in a select position; and c) said actuation tab is formed such that upon deflection of said actuation tab by an operator, said indexing portion is removed from said one indexing recess to facilitate linear displacement of said height adjustment cam to adjust the height of said nozzle above a floor.

19. A height adjustment arrangement according to claim 18, wherein said indexing portion comprises an indexing projection that is sized and shaped to be selectively received in each of said indexing recesses.

* * * * *